US005957272A

United States Patent [19]

Kim

[11] Patent Number: 5,957,272

[45] Date of Patent: Sep. 28, 1999

[54] PUSH BUTTON FOR CONTROL PANELS

[75] Inventor: Tae-Hong Kim, Incheon, Rep. of Korea

[73] Assignee: Daewoo Electronics Co., Ltd., Seoul, Rep. of Korea

[21] Appl. No.: 09/190,017

[22] Filed: Nov. 12, 1998

[30] Foreign Application Priority Data

Dec. 11, 1997 [KR] Rep. of Korea ..... 97-31819

[51] Int. Cl.[6] ..... H01H 3/00; H01H 13/70

[52] U.S. Cl. ..... 200/512; 200/302.2; 200/513; 200/341

[58] Field of Search ..... 200/5 R, 5 A, 200/5.2–5.7, 520, 341, 345, 302.2; 400/472, 490, 491.1, 491.2, 495, 495.1, 496

[56] References Cited

U.S. PATENT DOCUMENTS

| | | | |
|---|---|---|---|
| 4,441,001 | 4/1984 | Miyano et al. | 200/308 |
| 5,107,083 | 4/1992 | Yagi | 200/341 |
| 5,350,890 | 9/1994 | Fairbrother et al. | 200/5 A |
| 5,399,821 | 3/1995 | Inagaki et al. | 200/341 |
| 5,510,584 | 4/1996 | Norris | 200/5 A |

FOREIGN PATENT DOCUMENTS

| | | | |
|---|---|---|---|
| 279784A2 | 8/1988 | European Pat. Off. | H01H 13/70 |
| 407754A2 | 1/1991 | European Pat. Off. | H01H 13/70 |
| 653768A1 | 5/1995 | European Pat. Off. | H01H 13/70 |

*Primary Examiner*—Michael Friedhofer

*Attorney, Agent, or Firm*—Smith, Gambrell & Russell; Beveridge, DeGrandi, Weilacher & Young Intellectual Property Group

[57] ABSTRACT

A push button which is employed in a control panel includes button body, a pushing finger, and a core. The button body has hollow space formed at an inner portion thereof and a bellows portion formed around a side portion thereof. The pushing finger protrudes upwardly from an outer surface of an upper end portion of the button body for receiving a pushing force. The core is retained in the hollow space, and fixed at an inner surface of the closed upper end portion. When the bellows portion of the button body is elastically compressed by a pushing force, an other end portion of the core is protruded from the lower end portion of the button body, and when the pushing force is removed from the pushing finger, the other end portion of the core is retained in the hollow space.

8 Claims, 5 Drawing Sheets

PUSH BUTTON FOR CONTROL PANELS

BACKGROUND OF THE INVENTION

1. Field of the Invention

This invention relates to a push button for a control panel, more particularly to a push button which is used to control electric equipment, such as a car audio system, and a control panel in which the push button is used.

2. Description of the Prior Art

Generally, a control panel for a car audio system is provided with a plurality of push buttons for controlling various functions of the car audio system as well as a volume knob for controlling volume of the car audio system.

When one push button is pushed into a front bezel of the control panel, the push button moves into the rear side of the front bezel, such that an end portion of the push button contacts with an electric contact terminal formed on a printed circuit board. Contrarily, when the pushing force is removed from the push button, the push button is restored to the original position thereof by an elastic member installed at the rear potion of the push button.

FIG. 1 is a perspective, exploded view for showing a prior art control panel.

Referring to FIG. 1, the control panel includes a front bezel 10, a plurality of push buttons 11, an elastic pad 13, a plurality of electric switches 15, and a printed circuit board (hereinafter, referred to as PCB) 17. The front bezel 10 substantially has a flat shape. The front bezel 10 has a plurality of apertures. The elastic pad 13 is installed between the front bezel 10 and the PCB 17. The PCB 17 has a plurality of electric switches 15 which correspond to the plurality of apertures in their number and positions. Further, the elastic pad 13 has a plurality of holes corresponding to the plurality of electric switches 15. The plurality of push buttons 11 are installed between the front bezel 10 and the elastic pad 13. Each of the plurality of push buttons 11 includes a header 14, a collar 16 and a body 18. A diameter of the header 14 is less than that of the aperture formed at the front bezel 10, and a diameter of the collar 16 is more than that of the aperture formed at the front bezel 10. Therefore, the header 14 protrudes through the aperture from the outer surface of the front bezel 10, and the collar 16 prohibits the header 14 from falling out from the front bezel 10 by an elastic force of the elastic pad 13. The body 18 substantially has a bar shape. The length of the body 18 is less than a distance between the inner surface of the front bezel 10 and an upper surface of the electric switch 15. That is, the end surface of the body 18 is spaced from the upper surface of the electric switch 15.

Therefore, each electric switch 15 is operated by each push button 11.

However recently, as shown in FIG. 2, for improving the styling appearance of a control panel, a curved front bezel 20 has been introduced. It is difficult to control the electric switch 15 by the push button 11 since the operation direction of the push button 11 is not aligned with that of the electric switch 15. Further, the push button 11 frequently breaks due to excessively pushing the push button 11 for controlling the electric switch 15.

SUMMARY OF THE INVENTION

This invention has been made by taking the above fact into consideration, and an object of the present invention is to provide a push button for a control panel which can remove the aforementioned drawbacks and a control panel using improved pushing buttons.

To accomplish these objects, according to one aspect of the present invention, there is provided a push button for a control panel which comprises: a button body having a hollow space formed at an inner portion thereof and a bellows portion formed around a side portion thereof, the button body having an upper end portion which is closed and a lower end portion which is opened; a pushing finger protruded upwardly from an outer surface of the upper end portion of the button body for receiving a pushing force; and a core retained in the hollow space, the core having an end portion fixed at an inner surface of the closed upper end portion, wherein when the bellows portion of the button body is elastically compressed by a pushing force, an other end portion of the core is protruded from the lower end portion of the button body, and when the pushing force is removed from the pushing finger, the other end portion of the core is retained in the hollow space.

According to another aspect of the present invention, there is provided a control panel which comprises: a printed circuit board including a plurality of electrical contact terminals; a front bezel having a plurality of apertures corresponding to the plurality of electrical contact terminals of the printed circuit board; an elastic pad positioned between the printed circuit board and front bezel; and a plurality of push buttons formed on the elastic pad, wherein each of the plurality of push buttons includes a button body having a hollow space formed at an inner portion thereof and a bellows portion formed around a side portion thereof, the button body having an upper end portion which is closed and a lower end portion which is openned; a pushing finger protruded upwardly from an outer surface of the upper end portion of the button body for receiving a pushing force; and a core retained in the hollow space, the core having an end portion fixed at an inner surface of the closed upper end portion, wherein when the bellows portion of the button body is elastically compressed by a pushing force, an other end portion of the core is protruded from the lower end portion of the button body, and when the pushing force is removed from the pushing finger, the other end portion of the core is retained in the hollow space.

BRIEF DESCRIPTION OF THE DRAWINGS

This invention will be better understood and its various objects and advantages will be more fully appreciated from the following description taken in conjunction with the accompanying drawings, in which.

DETAILED DESCRIPTION OF THE PREFERRED EMBODIMENT

Preferred embodiments of the present invention will be illustrated below with reference to the accompanying drawings.

Figure 1:
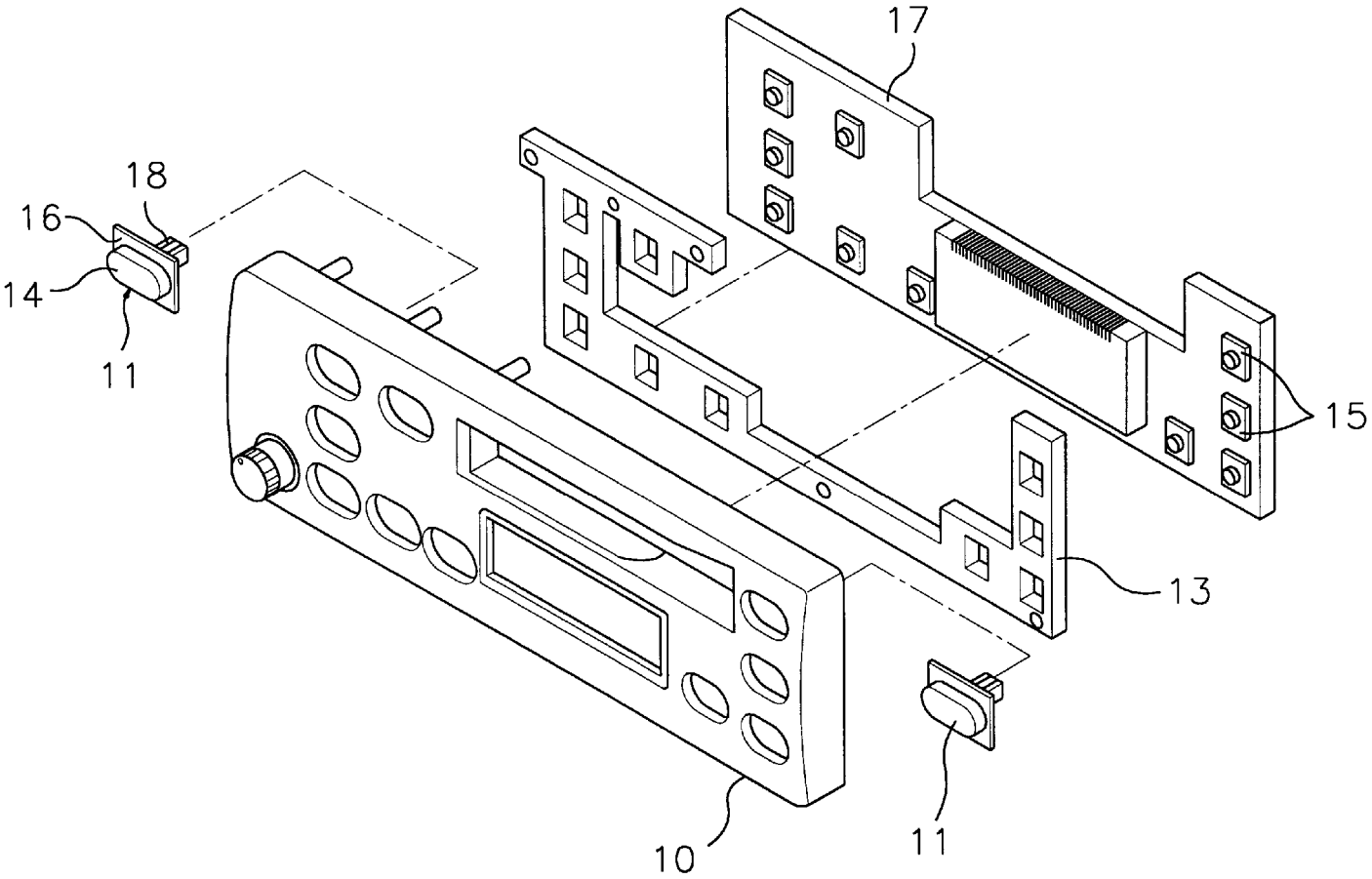
FIG. 1 PRIOR ART
FIG. 1 is a perspective, exploded view for showing a prior art control panel.
Figure 2:
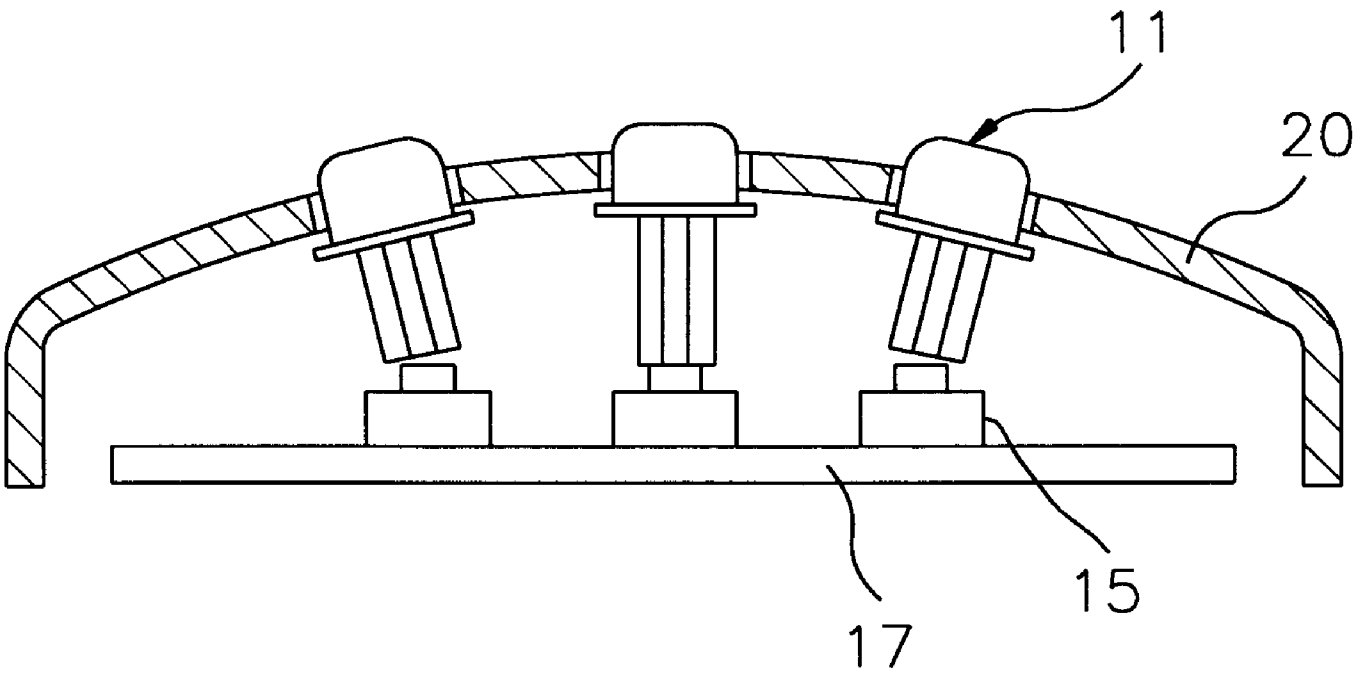
FIG.2 PRIOR ART
FIG. 2 is a sectional view for showing a prior art control panel including a curved front bezel.
Figure 3:
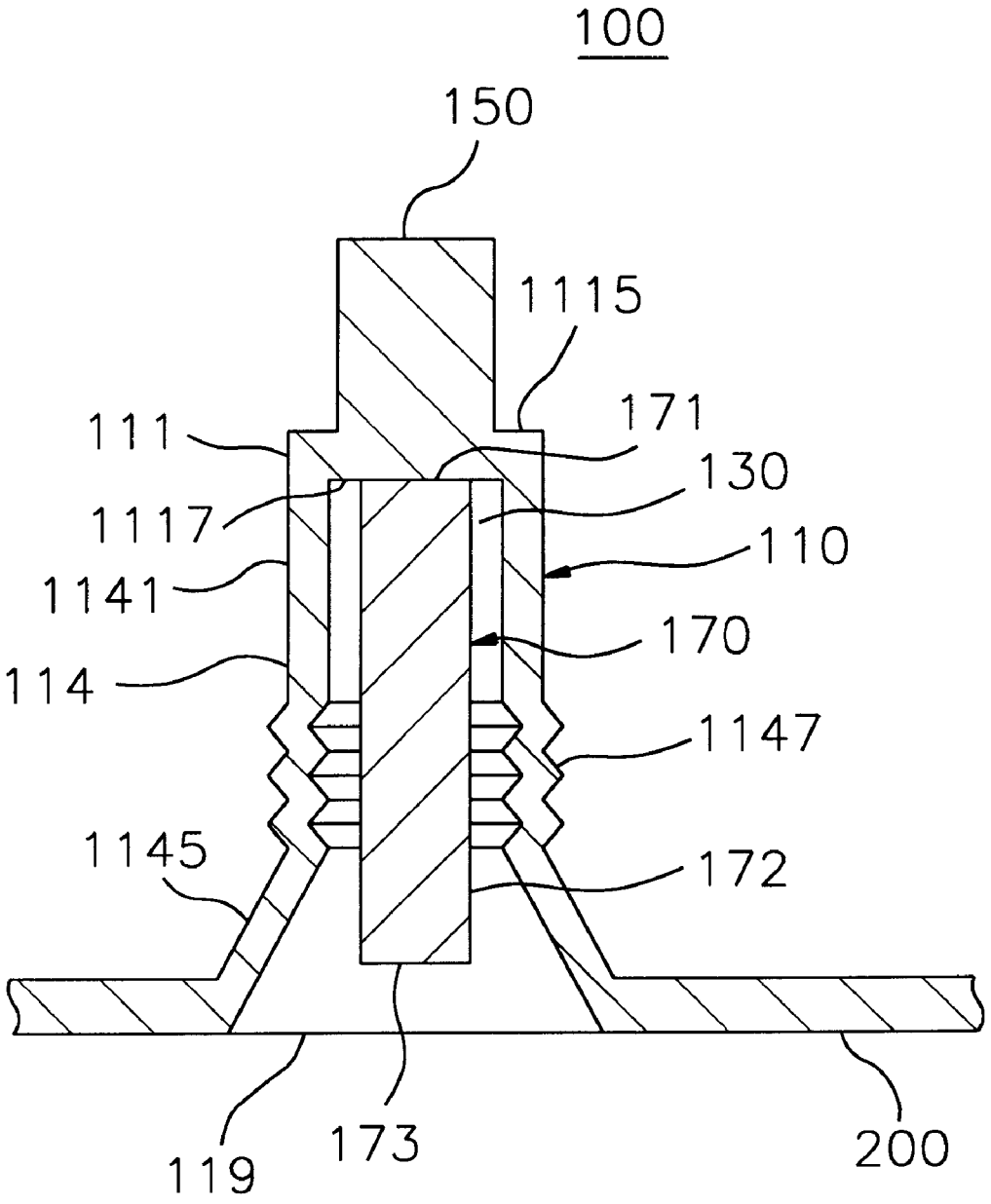
FIG. 3 is a sectional view for showing a push button according to the present invention.

FIG. 3 is a sectional view for showing a push button according to the present invention.

Referring to FIG. 3, a push button 100 according to the present invention includes a button body 110, a push finger 150, and a core 170. The button body 110 has a hollow space 130 which is formed in the button body 110 for retaining the core 170. Further, the button body 110 has a side portion 114, an upper end portion 111 which is closed, and a lower end portion 119 which is opened. The side portion 114 of the button body 110 is provided with a bellows portion 1147. The bellows portion 1147 is formed around the side portion 114 between an upper side portion 1141 and a lower side portion 1145. The upper side portion 1141 is formed between the upper end portion 111 and the bellows portion 1147 and substantially cylindrical shaped when viewed in a side. The lower side portion 1145 extends radially from a lower end of the bellows portion 1147. The lower side portion 1145 is outwardly inclined with respect to the vertical axis passing through each center of the lower and upper end portions 111 and 119, such that the lower side portion 1145 is substantially of a skirt shape when viewed in a side.

The push finger 150 is formed on an upper surface 1115 of the upper end portion 111. The push finger 150 protrudes upwardly from the outer surface 1115 of the upper end portion 111 along the vertical axis. Preferably, a diameter of the push finger 150 is less than that of the upper end portion 111.

The core 170 substantially has a bar shape. The core 170 is fixed to an inner surface 1117 of the upper end portion 111 of the button body 110. The core 170 has a side surface 172, an upper end surface 171 and a lower end surface 173. The upper end surface 171 is contacted with the inner surface 1117 of the upper end portion 111. The side surface 172 of the core 170 is spaced from the inner side surface of the side portion 114 of the button body 110.

When a user pushes the push finger 150 into the button body 110, the bellows portion 1147 of the button body 110 is elastically contracted, such that a length of the button body 110 is reduced to allow a lower end portion of the core 170 to protrude out of the hollow space 130 of the button body 110. When a pushing force is removed from the push finger 150, the bellows portion 1147 is restored by an elastic force thereof, such that the lower end portion of the core 170 is again inserted into the hollow space 130 of the button body 110.

Figure 4:
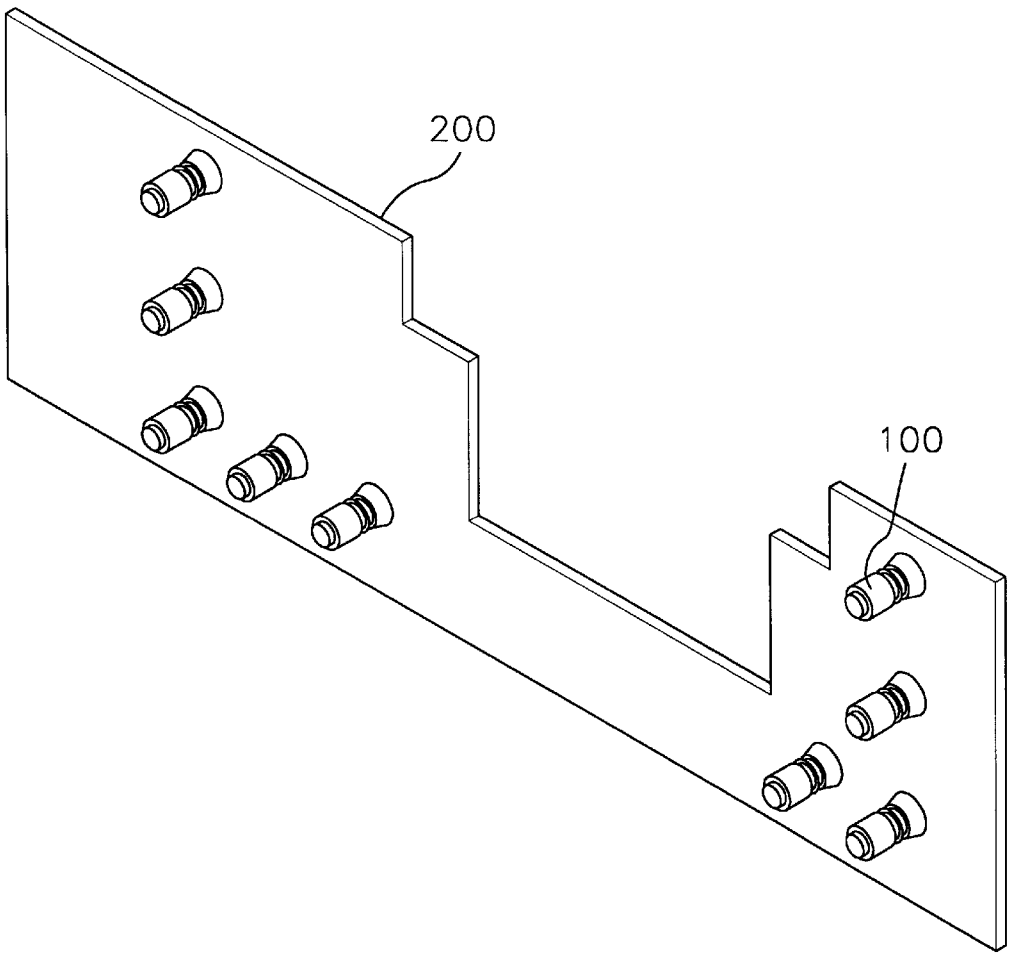
FIG. 4 is a perspective view for showing an elastic pad according to the present invention on which the plurality of push buttons depicted in FIG. 3 are formed.

FIG. 4 is a perspective view for showing an elastic pad according to the present invention on which a plurality of push buttons depicted in FIG. 3 are integrally formed.

Figure 5:
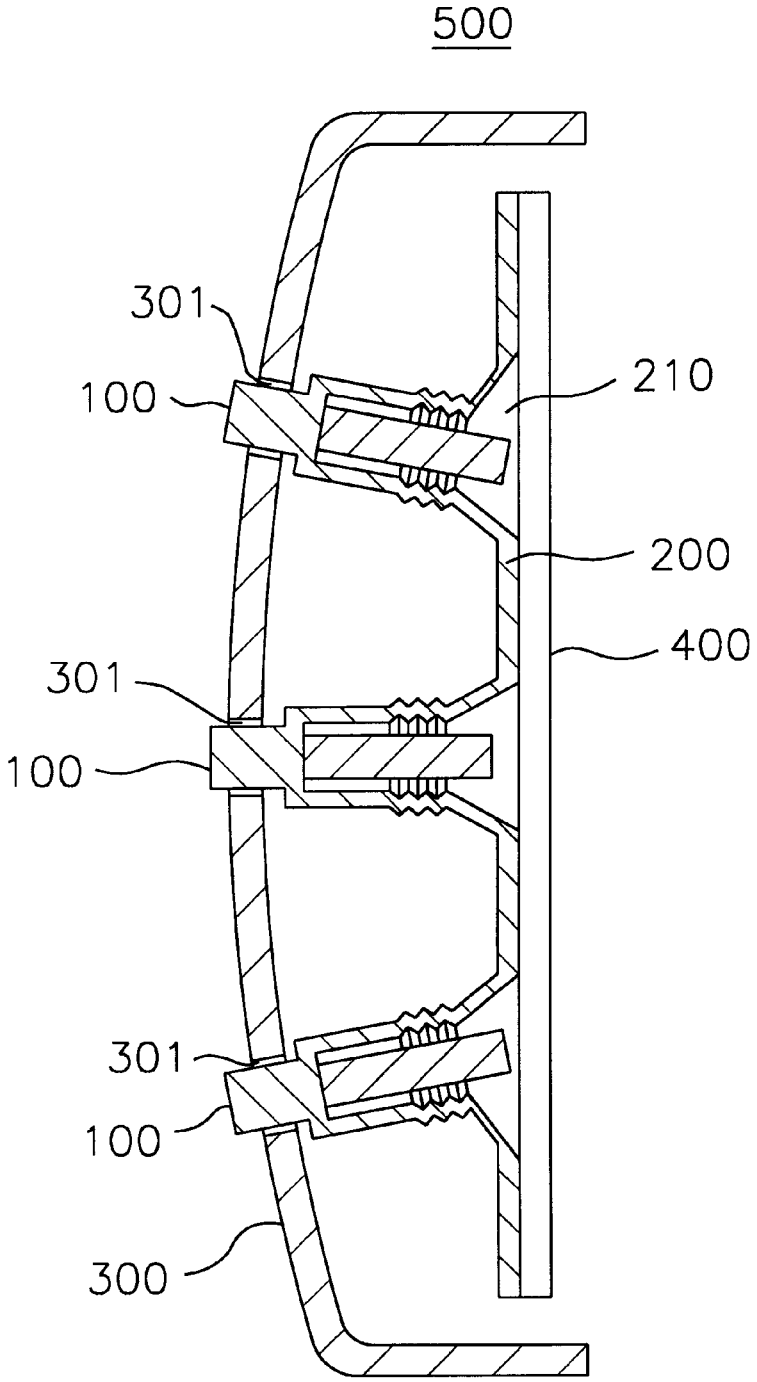
FIG. 5 is a sectional view for showing a control panel according to the present invention in which the elastic pad depicted in FIG. 4 is employed.

FIG. 5 is a sectional view for showing a control panel according to the present invention in which the elastic pad depicted FIG. 4 is used.

Referring to FIG. 5, the control panel 500 according to the present invention includes a plurality of push buttons 100, an elastic pad 200, a front bezel 300, and a printed circuit board 400.

The front bezel 300 has a plurality of apertures 301 for receiving the plurality of push buttons 100. Front and rear surfaces of the front bezel 300 are substantially curved. Therefore, vertical axes passing through each center of the plurality of apertures 301 are not parallel with one another.

The printed circuit board(hereinafter, referred to as PCB; 400) typically has a flat shape. The PCB 400 has a plurality of electric contact terminals(not shown). Further, the plurality of apertures 301 of the front bezel 300 correspond to the plurality of electric contact terminals of the PCB 400 in their number and positions.

As shown in FIG. 5, the elastic pad 200 is provided between the front bezel 300 and the PCB 400. The one surface of the elastic pad 200 is attached to the PCB 400, and the other surface of the elastic pad 200 is spaced from the front bezel 300. The elastic pad 200 has a plurality of openings 210, the number and positions of which correspond to those of the plurality of electric contact terminals on the PCB 400.

The plurality of push buttons 100, as shown in FIG. 3, which have the same structure, are formed on the elastic pad 200 to allow the plurality of openings 210 of the elastic pad 200 to be communicated with the hollow space 130 of each of the plurality of push buttons 100. The plurality of push buttons 100 are combined with the plurality of apertures 301 of the front bezel 300, respectively. That is, the push finger 150 of each push button 100 is inserted into each aperture 301 of the control panel 300 and the push button 100 is elastically supported from its rear portion by the elastic pad 200, such that each push button 100 is elastically combined with the front bezel 300. Further, since each of the plurality of push buttons 100 is able to pivot on the elastic panel 200 by the bellows portion 1147 thereof, the plurality of push buttons 100 are easily combined with the front bezel 300 without being affected by the shape of the front bezel 300, as shown in FIG. 5.

Therefore, according to the present invention, a push button is provided which can easily be combined with a curved front bezel and a control panel in which the push buttons are used.

While this invention has been particularly shown and described with reference to particular embodiments thereof, it will be understood by those skilled in the art that various changes in form and details may be effected therein without departing from the spirit and scope of the invention as defined by the appended claims.

What is claimed is:

1. A push button for a control panel comprising:

a button body having a hollow space formed at an inner portion thereof and a bellows portion formed around a side portion thereof, the button body having an upper end portion which is closed and a lower end portion which is opened;

a pushing finger protruded upwardly from an outer surface of the upper end portion of the button body for receiving a pushing force; and a core retained in the hollow space, the core having an end portion fixed at an inner surface of the closed upper end portion, wherein when the bellows portion of the button body is elastically compressed by a pushing force, an other end portion of the core is protruded from the lower end portion of the button body, and when the pushing force is removed from the pushing finger, the other end portion of the core is retained in the hollow space.

2. A push button as claimed in claim 1, wherein said side portion of the button body includes an upper side portion and a lower side portion, and the bellows portion is formed between the upper side portion and the lower side portion, wherein the upper side portion substantially has a cylindrical shape and the lower side portion substantially has a skirt shape, when viewed in a side.

3. A push button as claimed in claim 1, wherein said core substantially has a bar shape.

4. A push button as claimed in claim 1, wherein a diameter of the push finger is less than that of the button body.

5. A control panel comprising:

a printed circuit board including a plurality of electrical contact terminals;

a front bezel having a plurality of apertures corresponding to the plurality of electrical contact terminals of the printed circuit board;

an elastic pad positioned between the printed circuit board and the front bezel; and a plurality of push buttons formed on the elastic pad, wherein each of the plurality of push buttons includes:

a button body having a hollow space formed at an inner portion thereof and a bellows portion formed around a side portion thereof, the button body having an upper end portion which is closed and a lower end portion which is opened;

a pushing finger protruded upwardly from an outer surface of the upper end portion of the button body for receiving a pushing force; and a core retained in the hollow space, the core having an end portion fixed at an inner surface of the closed upper end portion, wherein when the bellows portion of the button body is elastically compressed by a pushing force, an other end portion of the core is protruded from the lower end portion of the button body, and when the pushing force is removed from the pushing finger, the other end portion of the core is retained in the hollow space.

6. A control panel as claimed in claim 5, wherein said side portion of the button body includes an upper side portion and a lower side portion, and the bellows portion is formed between the upper side portion and the lower side portion, wherein the upper side portion substantially has a cylindrical shape and the lower side portion substantially has a skirt shape, when viewed in a side.

7. A control panel as claimed in claim 5, wherein said core substantially has a bar shape.

8. A control panel as claimed in claim 5, wherein a diameter of the push finger is less than diameters of the button body and the plurality of apertures, and the diameter of the button body is more than that of each of the plurality of apertures.

* * * * *